US005182417A

United States Patent [19]

Rontey et al.

[11] Patent Number: 5,182,417

[45] Date of Patent: Jan. 26, 1993

[54] PRECISION DELAY DETONATOR

[75] Inventors: Daniel C. Rontey, Woodstock; Donald Bigando, Lake Katrine; Frank Wolfeil, Kingston, all of N.Y.

[73] Assignee: Ireco, Inc., Salt Lake City, Utah

[21] Appl. No.: 759,113

[22] Filed: Sep. 6, 1991

Related U.S. Application Data

[63] Continuation of Ser. No. 472,350, Jan. 30, 1990, abandoned.

[51] Int. Cl.[5] ..... F42B 3/10

[52] U.S. Cl. ..... 102/204; 102/275.11; 102/202.13; 102/202.14

[58] Field of Search ..... 102/200, 204, 205, 202.13, 102/202.14, 275.6, 275.8, 275.11

[56] References Cited

U.S. PATENT DOCUMENTS

| | | | |
|---|---|---|---|
| 3,556,009 | 1/1971 | Thatcher | 102/202.13 |
| 3,981,240 | 9/1976 | Gladden | 102/275.5 |
| 4,429,632 | 2/1984 | Yunan | 102/202.13 |
| 4,539,909 | 9/1985 | Day et al. | 102/205 |
| 4,809,610 | 3/1989 | Florin | 102/205 |

FOREIGN PATENT DOCUMENTS

| | | | |
|---|---|---|---|
| 196278 | 10/1986 | European Pat. Off. | 102/202.14 |
| 1127263 | 12/1956 | France | 102/200 |
| 3928140 | 12/1964 | Japan | 102/204 |
| 982364 | 2/1965 | United Kingdom | 102/200 |

*Primary Examiner*—Stephen M. Johnson
*Attorney, Agent, or Firm*—Thorpe North & Western

[57] ABSTRACT

A delay detonator for detonating an explosive charge includes a tubular member having a closed end and an open end, a primary base charge disposed in the closed end of the tubular member and capable of detonating the explosive charge when ignited, a delay train charge disposed adjacent to the primary base charge for burning in response to an ignition signal to thus ignite the primary base charge, an ignition source disposed in the tubular member near the open end for developing an ignition signal, and a transition element disposed between the delay train charge and the ignition source and responsive to an ignition signal from the ignition source for igniting to achieve a substantially steady state combustion rate to the ignite the delay train charge.

3 Claims, 1 Drawing Sheet

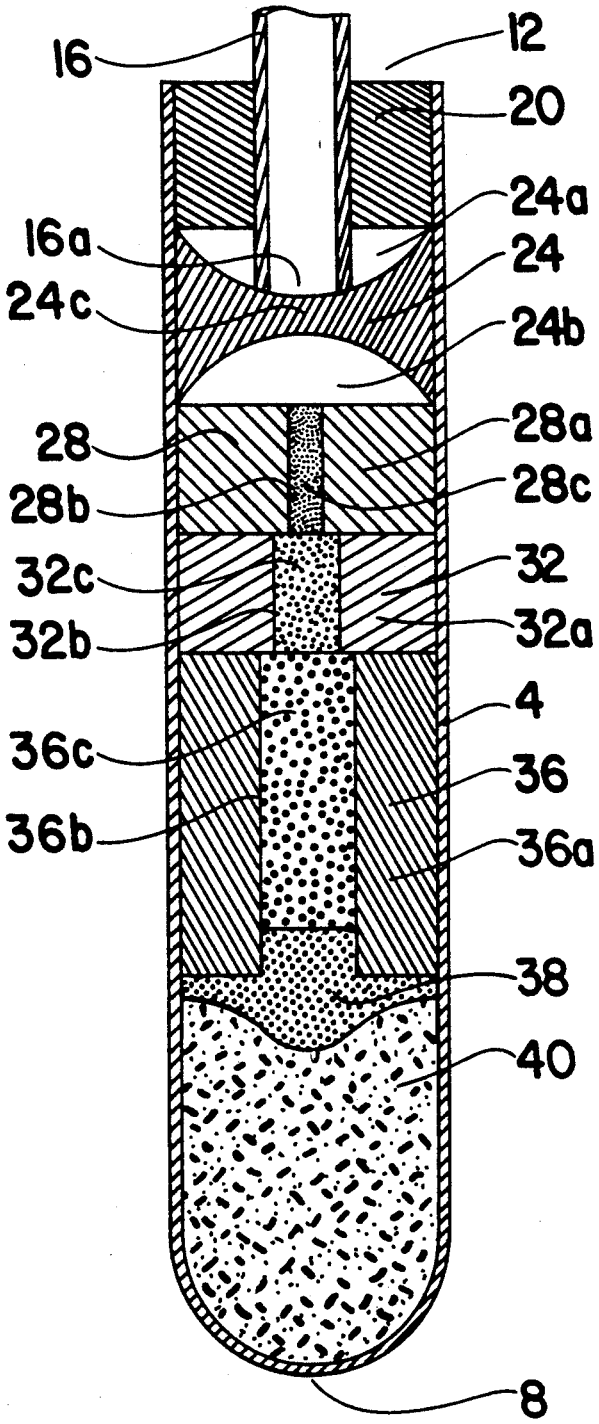
16
12
20
24a
16a
24
24c
24b
28
28a
28b
28c
32c
32
32b
32a
4
36c
36
36b
36a
38
40
8

PRECISION DELAY DETONATOR

This application is a continuation, of application Ser. No. 07/472,350, filed on Jan. 30, 1990 now abandoned.

BACKGROUND OF THE INVENTION

This invention relates to a delay detonator which incorporates a transition element for providing a stable ignition signal to a delay train charge of the detonator.

A delay blasting cap or delay-action detonator, used for detonating high explosives, is an explosive charge which detonates at a certain time interval after the ignition signal is generated. Currently used delay detonators employ a variety of different ignition signal sources such as match heads, primer spots, percussion primers, and shock tubes. The ignition signals produced by these ignition sources are supplied to one end of the sequence or train of charges, known as a delay train or delay element, to ignite the delay train. The delay train, in turn, ignites a primary and/or base charge which is used to detonate high explosive charges.

The output or ignition signal produced by the typical ignition sources mentioned above is highly dependant upon the mass or weight of the reactable material of the source. Thus, variations in this mass or weight can result in an ignition signal whose burn rate and intensity varies according to the variation in the weight. The delay train burning rate is, in turn, highly dependant upon the burning intensity of the ignition signal at the time of ignition and so the time delay from ignition of the delay train to ignition of the base charge can similarly vary. Since it is difficult to fabricate ignition sources, of whatever kind, within tight tolerances, precision in the timing of initiation of explosive charges is difficult to achieve. Of course, close control of such timing is important if reliable, effective and safe blasting is to be accomplished.

SUMMARY OF THE INVENTION

It is an object of the invention to provide a delay detonator in which the time interval between production of the ignition signal and ignition of the delay train is precisely controlled.

It is another object of the invention to provide such a delay detonator in which a variable ignition source signal may be converted into a substantially constant and stable delay train ignition stimulus.

It is a further object of the invention to provide such a delay detonator in which the delay train burning rate may be more precisely controlled.

The above and other objects of the invention are realized in a specific illustrative embodiment thereof which includes a tubular casing containing, in sequence, a base charge composed of a detonating explosive composition, a primary or priming charge composed of a heat-sensitive explosive composition, a delay charge disposed adjacent to the primary charge and composed of an exothermic-burning composition, an ignition source for producing an ignition signal, and a transition member separating the delay charge from the ignition source and composed of a material which readily ignites and, when ignited by the ignition signal, burns at a fairly rapid and substantially stable combustion rate. The transition member thus serves both to physically separate the ignition source from the delay charge and to transform what typically is a variable signal from the ignition source into a more consistent ignition signal for igniting the delay charge.

BRIEF DESCRIPTION OF THE DRAWING

The above and other objects, features and advantages of the invention will become apparent from a consideration of the following detailed description presented in connection with the accompanying drawing which shows a side, cross-sectional view of a portion of a delay detonator or blasting cap made in accordance with the principles of the present invention.

DETAILED DESCRIPTION

Referring to the drawing, there is shown a side, cross-sectional view of one illustrative embodiment of a delay detonator made in accordance with the present invention. The detonator includes a tubular casing 4 made of sheet metal or the like, such as aluminum, which is closed at one end 8 and is open at the other end for receiving an ignition source which, in the embodiment illustrated, constitutes a conventional non-electric shock tube 16. A bushing 20 is also positioned in the open end of the casing 4 to both hold the shock tube 16 in place and to protect the detonator assembly further along in the casing from accidental ignition by static charges which might accumulate on the shock tube. See, for example, U.S. Pat. No. 3,981,240.

An end 16*a* of the shock tube 16 is disposed adjacent to a static isolation cup 24 formed with upper and lower concave openings 24*a* and 24*b* separated by a thin web 24*c*. The static isolation cup 24 is in contact with the side walls of the casing substantially about the perimeter of the cup and is made of a conductive material to conduct static charges from the shock tube 16 through the static isolation cup 24 to the casing 4.

The next element in sequence in the casing 4 is a transition element 28 which constitutes the improvement of the present invention and will be discussed momentarily.

Positioned immediately after the transition element 28 is a sealer element 32 formed in the shape of a cylinder 32*a* having a central bore 32*b* filled with a combustible charge 32*c* for transferring an ignition signal from the transition element 28 to a delay train charge or fuse 36. The sealer element 32 is conventional in design and might, for example, be constructed of lead for the cylinder portion 32*a* so that as the combustible material 32*c* in the bore 32*b* ignites, the lead melts to seal the bore to prevent the escape of gas or vapors (which will ultimately be produced) back through the detonator assembly in the casing 4.

The fuse or delay train charge 36 is disposed immediately after the sealing element 32 and is provided to delay the ignition of a primary or priming charge 38 and then a base charge 40 for some predetermined period of time. The primary charge 38 is composed of a heat sensitive explosive composition and is, in some instances, combined with the base charge 40. The base charge 40 is composed of a detonating explosive composition and fills the remainder of the closed end 8 of the casing 4, as shown.

The delay train charge 36 is constructed of a cylindrical member 36*a* having an axially disposed bore 36*b* in which is disposed an exothermic-burning composition 36*c*. When ignited at the top end, the composition 36*c* burns over hopefully a predetermined period of time before it reaches the primary charge 38 to ignite the base charge 40. The burning or combustion rate of the composition 36c is very dependant upon the intensity of the ignition signal which ignites the composition and so, if the intensity or temperature of the ignition signal is high, the burning or combustion rate of the composition 36c will be greater and vice versa. Of course, the burning or combustion rate of the composition 36c determines the time required to ignite the primary charge 38 and base charge 40 and so, in order to achieve close tolerance on the delay time for igniting the base charge, it is important to provide a constant, stable ignition signal to the delay train charge 36. This, among other things, is the function and purpose of the transition element 28.

The transition element 28 includes a cup or ferrule formed in the shape of a cylinder 28a having a bore 28b in which is placed a reactable material 28c. The transition element 28, as is evident from the drawing, is positioned directly between the ignition source which in this case is the combustion of the shock tube 16 and static isolation cup 24, and the sealer element 32 leading to the delay train charge 36.

Advantageously the cylinder 28a is made of a non-combustible plastic material such as polyacetal. The reactable material 28c advantageously is selected to have a substantially constant, stable burn intensity, is readily ignitable by the ignition source, and has a relatively fast and steady combustion rate. The objective of selecting a reactable material with these characteristics is to enable transforming or converting what typically is a variable burn rate, variable intensity ignition source (shock tube 16) into a consistent ignition stimulus for igniting the delay train charge 36. Since the delay time interval is dependent upon the intensity of the signal by which it is ignited, close control of this delay time is dependent upon controlling the intensity of the ignition signal. Thus by appropriate selection of a reactable material 28c, a stable, quasi-steady state combustion rate can be achieved for initiating ignition of the delay train charge 36.

Among the materials exhibiting the characteristics described above for the reactable material 28c are zirconium/potassium perchlorate, lead azide, molybdenum/potassium perchlorate, lead styphnate and diazodinitrophenol, all of which would be prepared by packing the materials compactly in the bore 28b to form a substantially solid mass. Other materials which exhibit these characteristics, of course, would also be suitable. The selected material advantageously has a burn rate of about 0.060 sec./inch or greater and a burn temperature or intensity of about 600° C. or greater.

In the manner described above, a relative unstable and inconsistent initial ignition signal is transformed by a transition element into signal having a substantially constant burn rate and stable intensity for then igniting a delay train charge. The time interval of the delay is therefore more precisely determined to allow achievement of better timing and therefore better performance and use of delay detonators in blasting activities.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. In a delay detonator assembly comprising: (a) a tubular member having a closed end and an open end, (b) a base charge disposed in the closed end of the tubular member, (c) a primary charge disposed adjacent to the base charge and composed of a heat-sensitive explosive composition, (d) a delay charge disposed adjacent to the primary charge and composed of an exothermic-burning composition, (e) a sealer element disposed adjacent to the delay charge comprising a cylinder having a central bore holding a combustible charge for transferring an ignition signal from an ignition source to the delay charge, and (f) the ignition source also disposed in the tubular member near the open end thereof for producing the ignition signal, the improvement comprising:

a transition element separating the sealer element from the ignition source, said transition element comprising a rigid non-combustible annulus having a central bore holding a reactable material, said reactable material comprising lead azide having a burn rate of at least about 0.060 sec./inch or greater and a burn intensity of about 600° C. or greater, packed compactly in said bore into a substantially solid mass and which, when ignited by the ignition signal, develops a substantially constant intensity output for igniting the delay charge.

2. In a method of detonating a base charge of a detonator assembly comprising a tubular member having a closed end and an open end, said base charge disposed in the closed end of the tubular member, a primary charge disposed adjacent to the base charge and composed of a heat-sensitive explosive composition, a delay charge disposed adjacent to the primary charge and composed of an exothermic-burning composition, a sealer element disposed adjacent to the delay charge comprising a cylinder having a central bore holding a combustible charge for transferring an ignition signal from an ignition source to the delay charge, and the ignition source also disposed in the tubular member near the open end for producing the ignition signal, which method comprises the steps of (a) producing the initial ignition signal at said ignition source, (b) igniting said combustible charge in said sealer element by the ignition signal, (c) igniting said delay train charge by the combustible charge in said sealer element, and (d) igniting said primary and base charges by means of the exothermic burning of said delay train charge, the improvement comprising:

(i) providing a transition element in said detonator assembly separating the sealer element from the ignition source said transition element comprising a rigid non-combustible annulus having a central bore holding a reactable material, said reactable material comprising lead azide having a burn rate of at least about 0.060 sec./inch or greater and a burn intensity of about 600° C. or greater, packed compactly in said bore into a substantially solid mass and which, when ignited, develops a substantially constant intensity output, and (ii) applying said ignition signal to said transition element causing said reactable material to ignite and burn at a relatively constant and stable burn rate and intensity, which in turn ignites said combustible charge in said sealer element and said delay train charge at said relatively constant burn and intensity thereby causing the exothermic burning of said delay train charge over a predetermined period before igniting said primary and base charges.

3. A delay detonator assembly comprising:

a tubular member having a closed end and an open end, a base charge disposed in the closed end of the tubular member, a primary charge disposed adjacent to the base charge and composed of a heat-sensitive explosive composition, a delay charge disposed adjacent to the primary charge and composed of an exothermic-burning composition, a sealer element disposed adjacent to the delay charge comprising a cylinder having a central bore holding a combustible charge for transferring an ignition signal from an ignition source to the delay charge, the ignition source also disposed in the tubular member near the open end thereof for producing the ignition signal, a static isolation device incorporated into the ignition source, a rigid non-combustible annulus separating the sealer element from the ignition source, the rigid non-combustible annulus having a central bore, and a reactable material packed compactly in said central bore into a substantially solid mass, said reactable material comprising lead azide having a burn rate of at least about 0.060 sec./inch or greater and a burn intensity of about 600° C. or greater which, when ignited by the ignition signal, develops a substantially constant intensity output for igniting the delay charge.

* * * * *